US008460234B1

(12) United States Patent
Duron-Smith

(10) Patent No.: US 8,460,234 B1
(45) Date of Patent: Jun. 11, 2013

(54) AUTOMATIC HYDRATING DEVICE FOR INVALIDS AND THE DISABLED

(76) Inventor: Olivia Duron-Smith, Anchorage, AK (US)

( * ) Notice: Subject to any disclaimer, the term of this patent is extended or adjusted under 35 U.S.C. 154(b) by 1224 days.

(21) Appl. No.: 11/387,296

(22) Filed: Mar. 23, 2006

(51) Int. Cl.
*A61J 7/00* (2006.01)

(52) U.S. Cl.
USPC ..... 604/77

(58) Field of Classification Search
USPC . 604/65–68, 77, 78, 79, 27, 39–42; 215/11.1, 215/387; 220/705; 222/211, 175, 626
See application file for complete search history.

(56) References Cited

U.S. PATENT DOCUMENTS

| | | | | |
|---|---|---|---|---|
| 3,587,934 | A * | 6/1971 | Elmore | 222/171 |
| 4,966,580 | A * | 10/1990 | Turner et al. | 604/67 |
| 5,634,896 | A * | 6/1997 | Bryant et al. | 604/29 |
| 5,645,404 | A * | 7/1997 | Zelenak | 417/1 |
| 6,537,244 | B2 * | 3/2003 | Paukovits et al. | 604/65 |
| 2004/0045980 | A1 * | 3/2004 | Robins | 222/63 |
| 2005/0029319 | A1 * | 2/2005 | Robins et al. | 224/148.2 |

* cited by examiner

*Primary Examiner* — Nicholas Lucchesi
*Assistant Examiner* — Jenna Zhang
(74) *Attorney, Agent, or Firm* — Michael J. Tavella

(57) ABSTRACT

A water bottle and dispenser system that allows a measured quantity of water to be supplied to the patient's mouth automatically. The delivery of the water can be timed for any convenient interval. There is no need for specialized needles and other paraphernalia related to an IV, and no specialized training is needed to install and operate the device. This means that a homeowner can use this device for a patient at home, which will reduce the cost of treatment.

16 Claims, 4 Drawing Sheets

AUTOMATIC HYDRATING DEVICE FOR INVALIDS AND THE DISABLED

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to an automatic hydrating device for invalids and the disabled and particularly to an automatic hydrating device for invalids and the disabled that provides measured quantities of water directly to a patient's mouth.

2. Description of the Prior Art

Alzheimer's patients and other disabled people often become dehydrated because they either forget to drink adequate amounts of water, or are able to do so for themselves. Obviously, people need to drink water throughout the day to remain hydrated. Often it is impossible for these patients to drink a full glass of water at regular intervals. That means caregivers must be employed to ensure they receive enough water, or intravenous means (IV) must be used to ensure hydration.

Both of these methods are costly and require adequately trained personnel. Moreover, the use of an IV requires equipment that often restrains and restricts the movement of the patient. Finally, the use of an IV for extended periods may be problematic and dangerous for the patient.

BRIEF DESCRIPTION OF THE INVENTION

The instant invention overcomes these difficulties. It is a water bottle and dispenser system that allows a measured quantity of water to be supplied to the patient's mouth automatically. The delivery of the water can be timed for any convenient interval. There is no need for specialized needles and other paraphernalia related to an IV, and no specialized training is needed to install and operate the device. This means that a homeowner can use this device for a patient at home, which will reduce the cost of treatment.

DETAILED DESCRIPTION OF THE INVENTION

Figure 1:
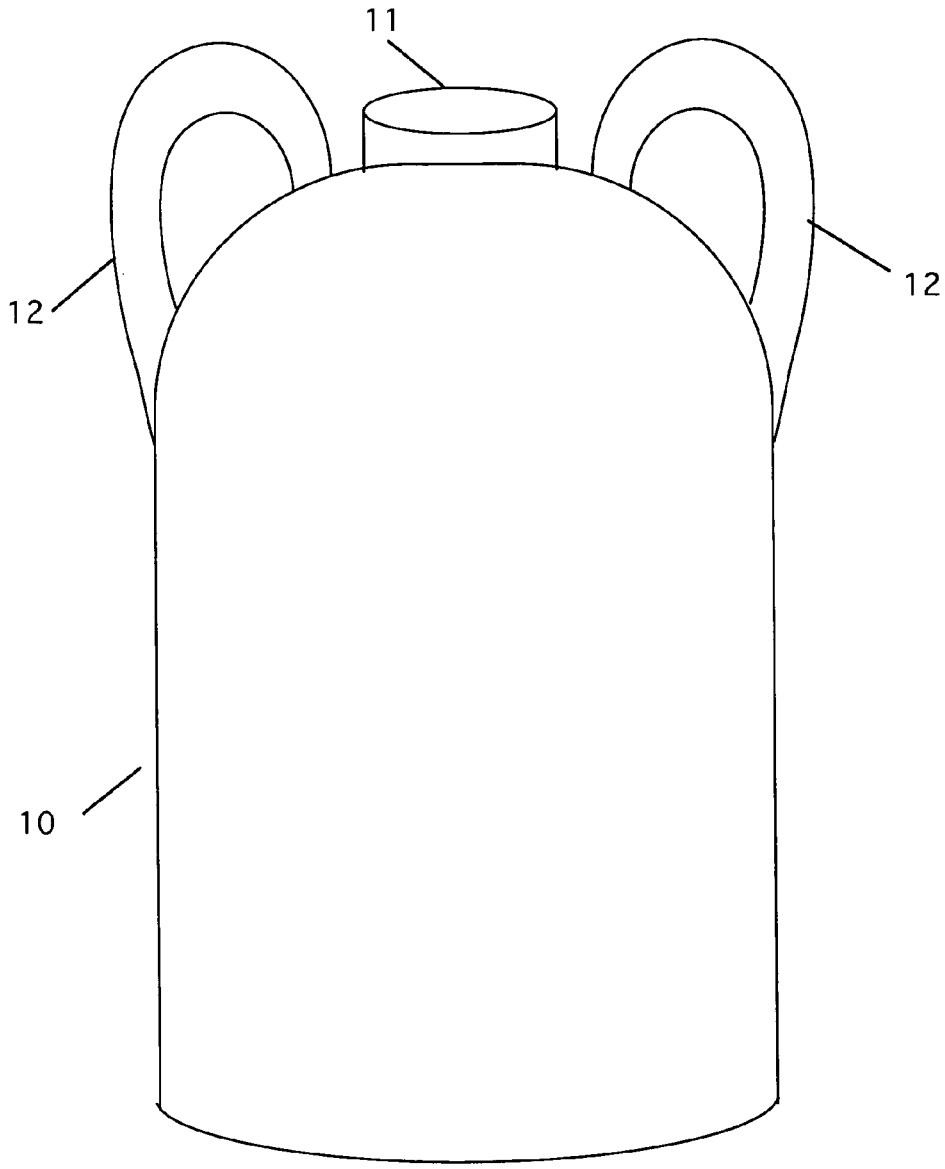
FIG. 1 is a side view of the collapsible water dispenser bottle fully expanded.
Figure 2:
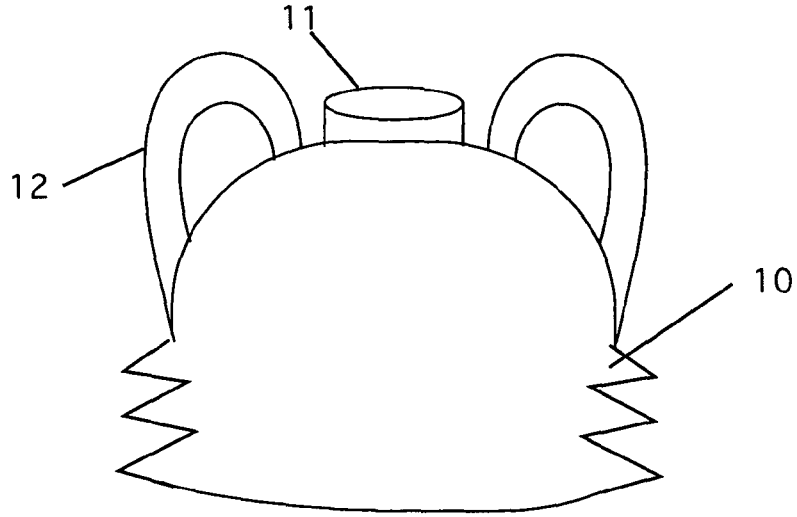
FIG. 2 is a side view of the collapsible water dispenser bottle fully collapsed.

Referring now to FIG. 1, the system begins the water bottle 10. The bottle is lightweight plastic. It has an opening 11 and optional handles 12. The bottle is designed to be collapsible, as shown in FIG. 2.

Figure 3:
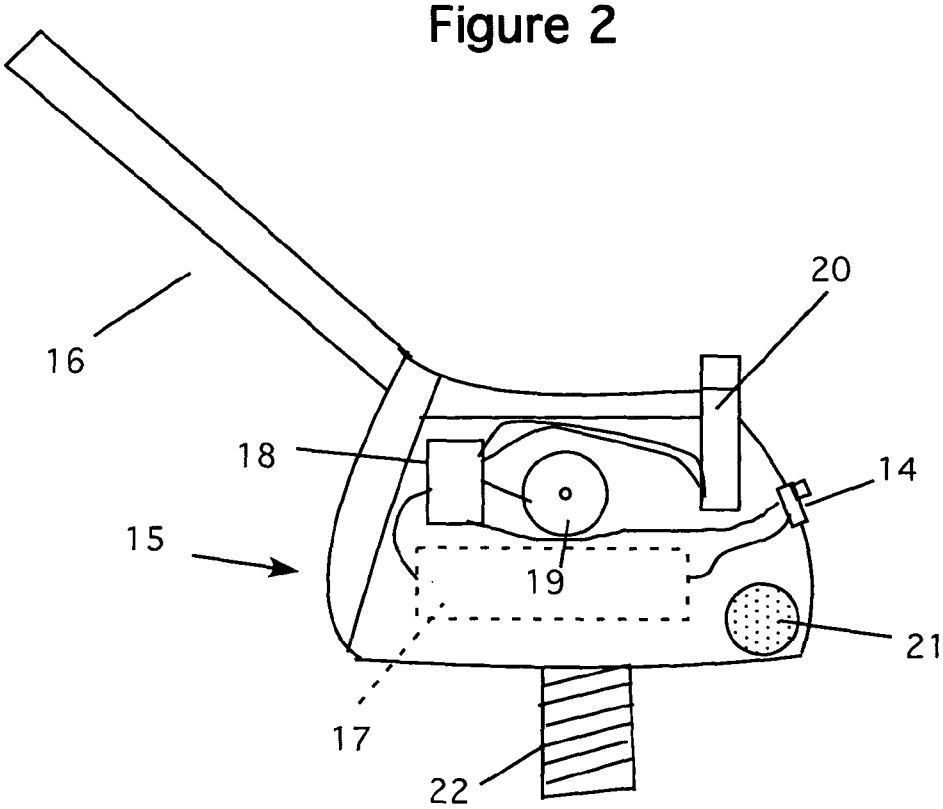
FIG. 3 is a side view of the control unit.

FIG. 3 is a side view of the control unit 15. The control unit (or automatic dispenser unit) is the heart of the system. It acts as an automatic dispensing means. It has a master on-off switch 14. It also has a straw 16 that extends outward as shown. The length of the straw can be varied, depending on the location of the bottle and the position of the patient. The straw is designed to be placed in the user's mouth so that the patient can receive water (or other fluids) at timed intervals. The control unit 15 has a battery 17 to power the timer unit 18. An adjustable switch 19 is used to control the water flow. It has a range of values to enable proper water flow under a variety of conditions. A "squirt" button 20 is provided to supply a small quantity of water to the patient manually. It is also possible to simply suck water from the bottle, if desired. An alarm 21 can be included in the device as well. The alarm can be audible, working through a speaker, or a light, which glows red, for example, if the straw is not properly positioned. The alarm works in conjunction with the sensor 26 (see FIG. 4) to indicate an alarm condition. The control unit also has a threaded portion 22 that screws into the neck 11 of the container, as discussed below.

Figure 6:
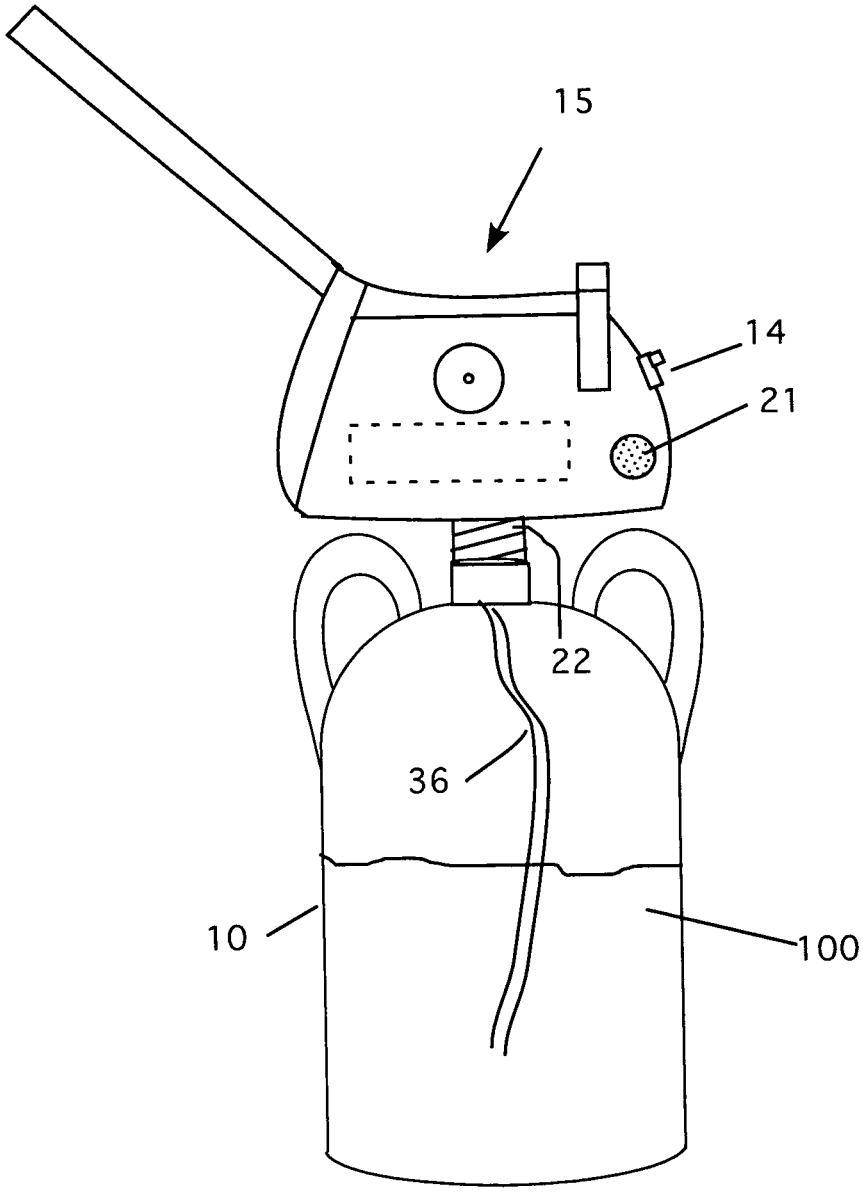
FIG. 6 is a side view of the assembled bottle and control unit.

The control unit also has a threaded connector 21 that allows the unit to be screwed onto the water bottle 10 (see FIG. 6).

Figure 4:
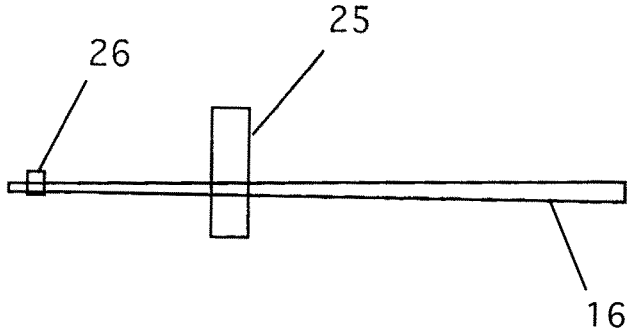
FIG. 4 is a side view of the straw extension and clip.

FIG. 4 is a side view of the straw extension. This is the portion of the straw 16 that enters the mouth of the user. A clip 25 is provided to attach the straw to the patients clothing or pillow case. The straw 16 has a sensor 26 at the end that signals the control unit when the straw is in the user's mouth. If the straw is removed, or inadvertently falls out of the user's mouth, the control unit will not operate. This prevents water from being sprayed on the patient in the event of an accidental removal of the straw. It also prevents the bed from being soaked, if the patient is removed and the device is inadvertently left on.

Figure 5:
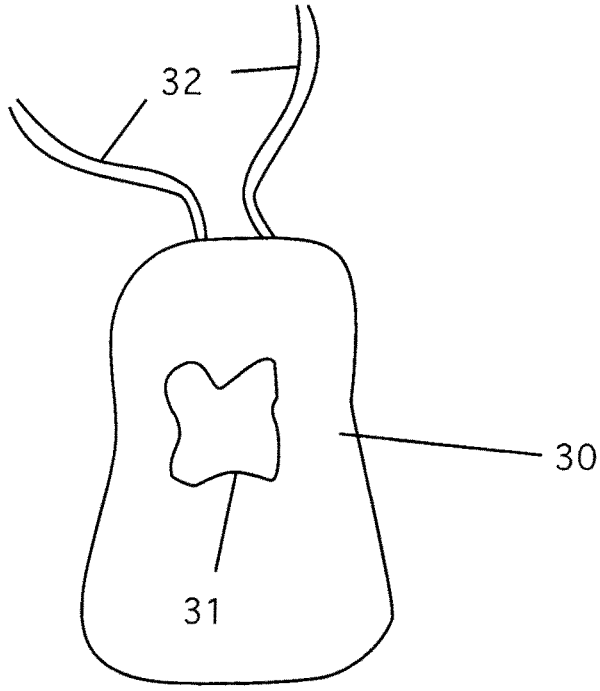
FIG. 5 is a detail view of a soft bag that holds the water bottle.

FIG. 5 is a detail view of a soft bag 30 that holds the water bottle 10 and control unit 15. The bag is designed to clip to the patient's clothing with a clip 31. The bag has a pull cord 32 to close the bag when it is in use. In this way, the patient can have an aesthetically pleasing water delivery system while incapacitated.

FIG. 6 is a side view of the assembled bottle and control unit. This figure shows the assembled unit. In the preferred embodiment, the bottle 10 is an 18-ounce bottle. It holds an amount of a potable fluid 100, such as water. A small hose 36 is used to extract water from the bottle by the pump unit in the control unit. As the bottle is emptied, it is designed to collapse (see FIG. 2). This ensures complete removal of the water from the bottle over the desired time interval.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An automatic hydrating device comprising:

a) a control unit having a housing having an inlet port, and an outlet port spaced apart from said inlet port;

b) a pump installed entirely within said housing and being having a discharge port connected to said outlet port; and c) a controller mounted entirely within said housing operably attached to said pump whereby said controller causes said pump to operate automatically to dispense a measured quantity of a beverage on a timed basis;

d) a container for holding a quantity of a beverage, said container having a neck, whereby the neck of said container is removably attached to said inlet port on said control unit; and e) a fluid dispensing tube, having a distal end and a proximate end, the proximate end being attached to the outlet port of said control unit such that the fluid dispensing tube has no physical connection to said container, and further wherein the distal end of said fluid dispensing tube is positioned in a patient's mouth.

2. The automatic hydrating device of claim 1 wherein said container is filled with a potable fluid.

3. The automatic hydrating device of claim 2 wherein the control unit further includes an adjustable switch for controlling the amount of said measured quantity of said potable fluid from said container.

4. The automatic hydrating device of claim 1 wherein the controller further includes a timer control.

5. The automatic hydrating device of claim 1 further comprising a means for providing power to said control unit.

6. The automatic hydrating device of claim 5 wherein the means for providing power comprises a battery.

7. The automatic hydrating device of claim 1 wherein the control unit further includes a squirt button to provide a manual override of said controller.

8. The automatic hydrating device of claim 1 further comprising a sensor installed on said fluid dispensing tube and being in electrical communication with the controller such that said sensor signals the controller when the fluid dispensing tube is in the user's mouth, said signal providing an auxiliary control for said controller to prevent said beverage from being dispensed from the container if said fluid dispensing tube is not in the patient's mouth.

9. The automatic hydrating device of claim 1 further comprising a soft bag that holds the container and said control unit.

10. The automatic hydrating device of claim 9 further comprising a clip for securing the soft bag to an article of clothing being worn by the patient.

11. The automatic hydrating device of claim 1 further comprising an alarm in electrical communication with said sensor and said controller, whereby when said sensor is not in said patient's mouth, said controller causes said alarm to indicate an alarm condition.

12. The automatic hydrating device of claim 11 wherein said alarm includes a speaker for providing an audible alarm.

13. The automatic hydrating device of claim 11 wherein said alarm includes at least one warning light, attached to said control unit.

14. The automatic hydrating device of claim 1 wherein the neck of the container is threaded.

15. The automatic hydrating device of claim 14 wherein the inlet port of the control unit is threaded onto the neck of the container.

16. The automatic hydrating device of claim 1 wherein the container is collapsible.

* * * * *